US006325345B1

(12) United States Patent
Carpenter

(10) Patent No.: US 6,325,345 B1
(45) Date of Patent: Dec. 4, 2001

(54) PANEL WALL HANGER AND FILE HOLDER

(75) Inventor: Kevin D. Carpenter, Jacksonville, FL (US)

(73) Assignee: Advantus Corporation, Jacksonville, FL (US)

( * ) Notice: Subject to any disclaimer, the term of this patent is extended or adjusted under 35 U.S.C. 154(b) by 0 days.

(21) Appl. No.: 09/539,743

(22) Filed: Mar. 31, 2000

(51) Int. Cl.[7] ..... A47B 96/06
(52) U.S. Cl. ..... 248/217.3; 248/304; 40/661
(58) Field of Search ..... 248/217.3, 218.3, 248/304, 301, 303, 916; D8/370; 40/661; 211/59.1

(56) References Cited

U.S. PATENT DOCUMENTS

D. 404,287 * 1/1999 Hepworth .
2,127,234 * 8/1938 Reiter .
2,228,949 * 1/1941 Field .
3,146,981 * 9/1964 Wheeler .
3,861,631 * 1/1975 Shorin .
4,034,865 * 7/1977 Batts et al. .
4,580,667 * 4/1986 Herwood .
5,029,788 * 7/1991 Hoskinson et al. .
5,269,485 * 12/1993 Dwinell et al. .
5,547,077 * 8/1996 Wang .

* cited by examiner

*Primary Examiner*—Ramon O. Ramirez
*Assistant Examiner*—Korie H. Chan
(74) *Attorney, Agent, or Firm*—Arthur G. Yeager

(57) ABSTRACT

This invention relates to a hook-shaped hanger adapted to be attached by a pair of spaced prongs to a vertical panel wall and adapted to support an envelope of plastic film that hangs form that hook-shaped hanger to serve as a temporary file repository for a user. The hook-shaped hanger includes a ridge across the outside surface of the hook that retains the envelope on the hook when a file or the like is being removed from the envelope. The envelope may be a single file envelope supported by a single hanger or a multifile expandable envelope supported by two spaced hangers.

20 Claims, 3 Drawing Sheets

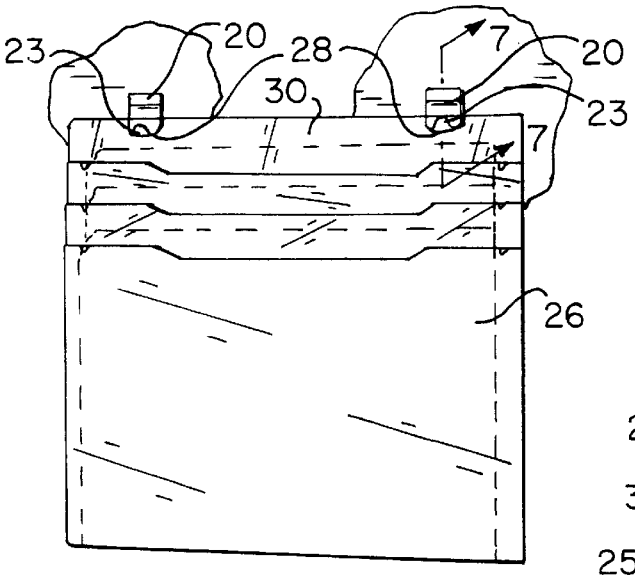
FIG. 9
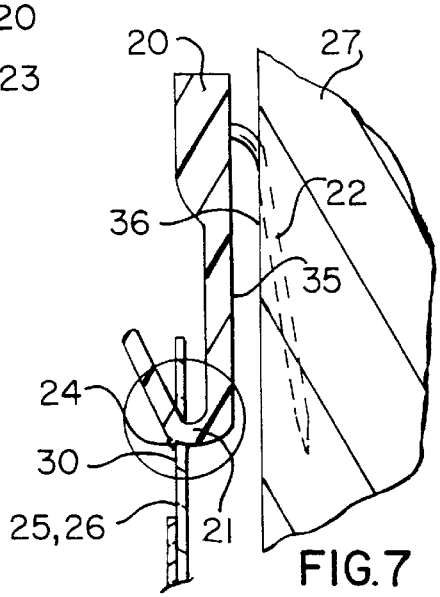
FIG. 7
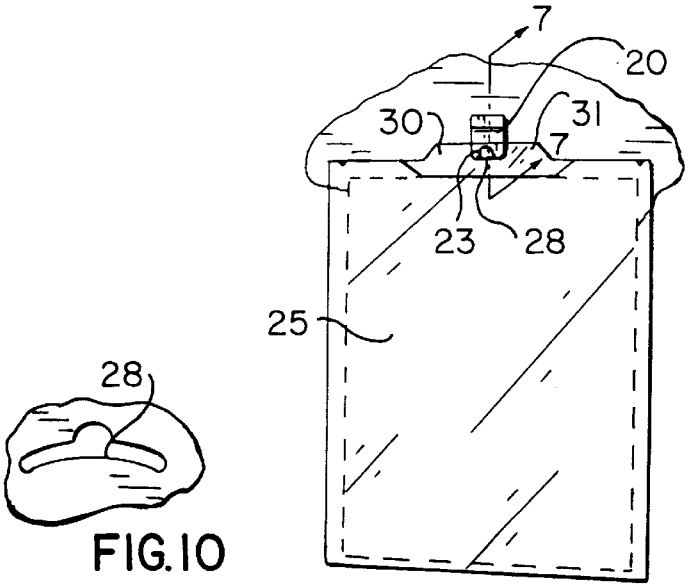
FIG. 8
FIG. 10
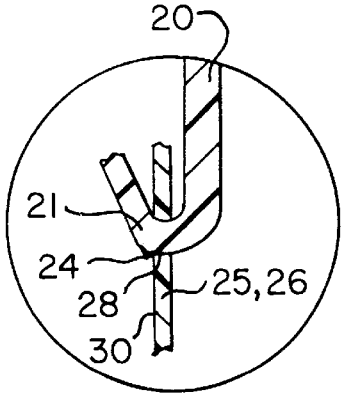
FIG. 11

PANEL WALL HANGER AND FILE HOLDER

CROSS REFERENCE TO RELATED APPLICATIONS

There are two patent applications currently filed entitled PANEL WALL ORGANIZER, Ser. No. 29/119,670; Confrm No. 6701, filed Mar. 3, 2000 and PANEL WALL HANGER U.S. Design Pat. No. D436,841, dated Jan. 30, 2001.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Field of the Invention

This invention relates to a wall-mounted file holder, and more particularly, it relates to a transparent pocket for a file and a means for attaching that pocket to a vertical wall.

2. Description of the Related Art

The only known related art is a spring-loaded clip for suspending a paper from the clip and attaching it to a wall via a pair of spaced prongs integral with the back of the clip.

BRIEF SUMMARY OF THE INVENTION

This invention relates to a transparent bolder for a file folder and the combination of that file holder and a hook-shaped hanger for the file holder that is attachable to a vertical wall. The hook-shaped hanger is attachable to the wall by means of two parallel spaced prongs projecting outwardly and downwardly from the back of the hanger. The lower front portion of the hanger is hook-shaped to receive a slotted opening formed in an upper flap of a transparent plastic envelope that serves as a file holder in this invention. The invention includes as one embodiment the combination of one hook-shaped hanger from which there is suspended a single plastic envelope; and a second embodiment which is the combination of two hook-shaped hangers and a large expandable plastic envelope of several compartments that may hold several file folders, the two hangers being widely separated and the large envelope being suspended from two slots designed to accept a hook-shaped hanger in each slot. A specific improvement feature of each hanger is found in the design of each hook to include a sharp ridge or shoulder on the outside lower surface of each hook positioned such that the slot for each envelope will slightly deform and just pass over the ridge on the hook, in a snap lock manner, before reaching its final hanging position; and the ridge will serve to prevent the envelope from sliding off the hook when a file is removed from the envelope.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

FIG. 7 is a partial cross-sectional view of the hook-shaped hanger and the file holder as shown along line 7—7 of FIG. 8 or FIG. 9;

FIG. 8 is a front elevational view of a hook shaped hanger supporting a single file holder in accordance with the present invention;

FIG. 9 is a front elevational view of a pair of hook-shaped hangers supporting a multiple file holder in accordance with the present invention;

FIG. 10 is a partial front elevational view showing the slotted opening of either file holder of FIG. 8 or 9; and FIG. 11 is an enlarged cross-sectional view of the portion shown in a circle in FIG. 7.

DETAILED DESCRIPTION OF THE INVENTION

Figure 1:
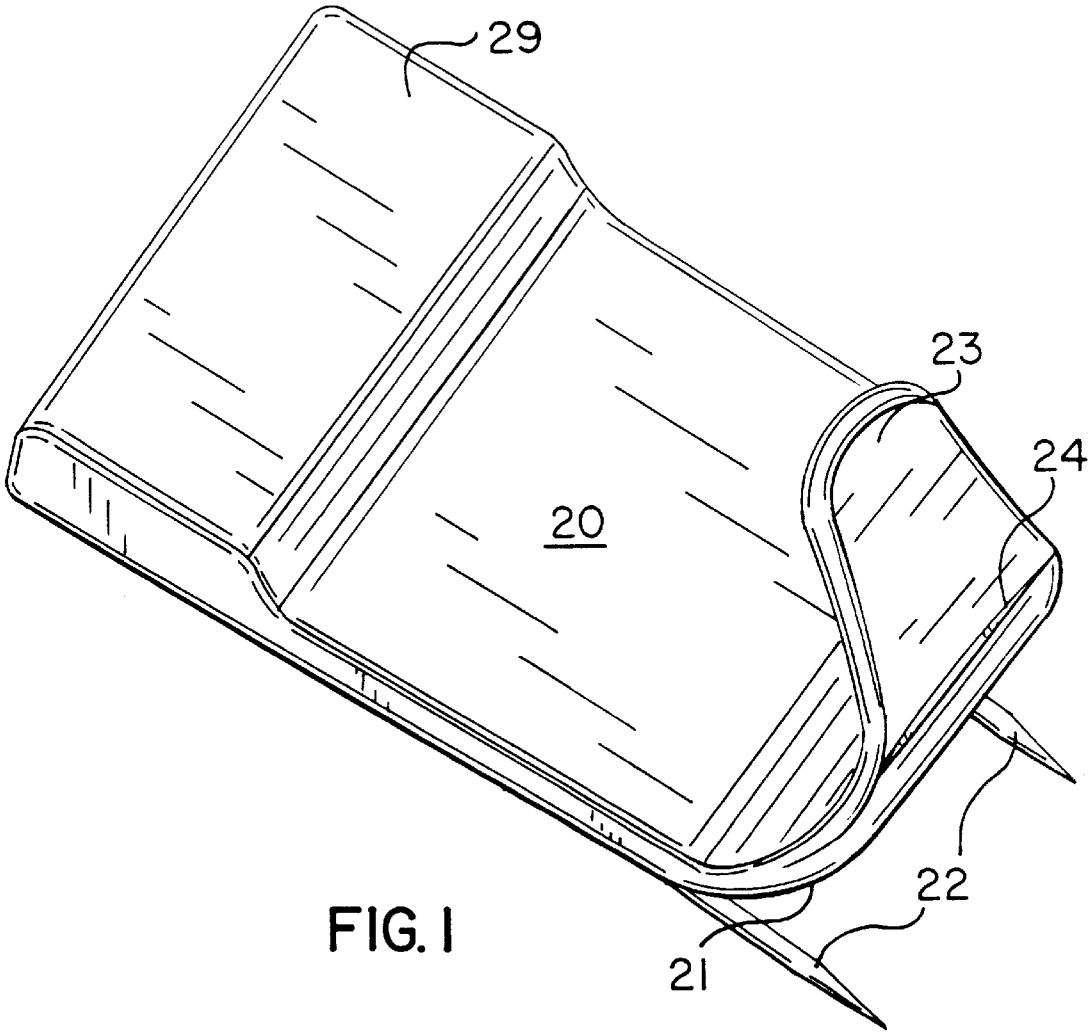
FIG. 1 a perspective view of the hook-shaped hanger of the present invention.
Figure 2:
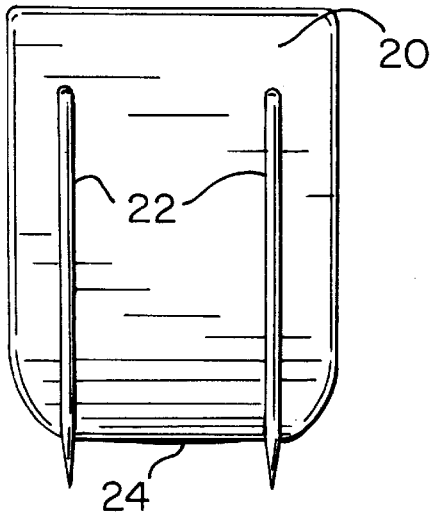
FIG. 2 is a rear elevational view of the hook-shaped hanger of the present invention.
Figure 3:
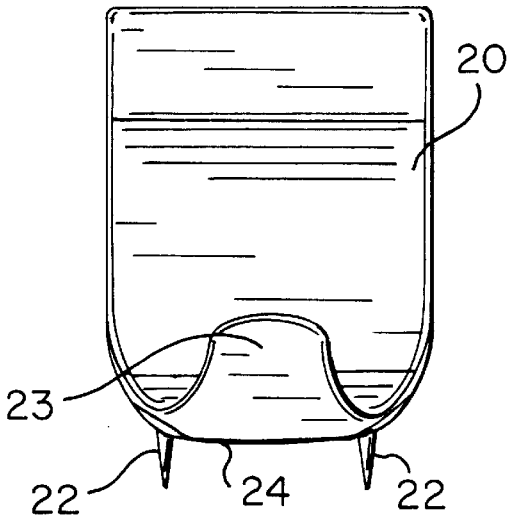
FIG. 3 is a front elevational view of the hook-shaped hanger of the present invention.
Figure 4:
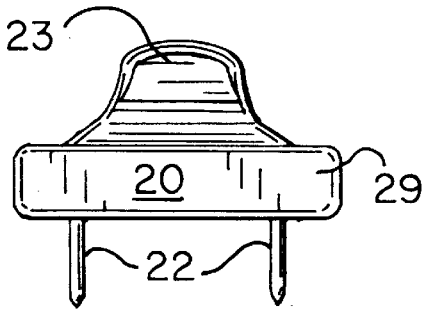
FIG. 4 is a top end elevational view of the hook-shaped hanger of the present invention.
Figure 5:
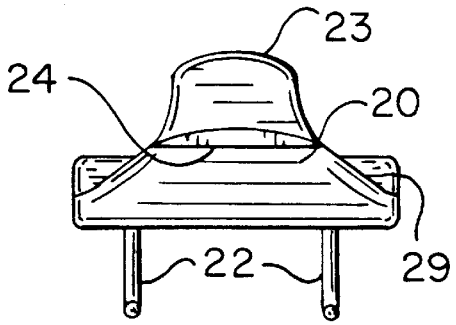
FIG. 5 is a bottom end elevational view of the hook-shaped hanger of the present invention.
Figure 6:
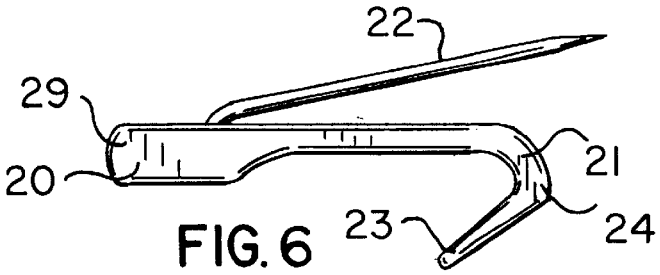
FIG. 6 is a side elevational view of the hook-shaped hanger of the present invention.

The present invention is a temporary readily accessible file holder for a typist, computer operator, telephone operator, etc. who needs a place to store a file and has nothing but wall space available for such a purpose. This invention provides a pocket large enough to enclose a file folder and one or two hangers to attach the pocket to a vertical wall, commonly a panel wall, that is receptive to pins or prongs that can be attached to the wall by the force of human fingers. The invention includes the combination of one or more hangers that has prongs pushed into the wall and a plastic film pocket that is hung from a hook on the bottom of the hanger. The features of this invention are seen in the attached drawings wherein FIGS. 1–6 show the hook-shaped hanger and FIGS. 7–10 show how the hanger of FIGS. 1–6 is employed to support two different sizes of file holders.

FIGS. 1–6 show the features of the hanger that is attachable to a vertical wall and from which a plastic film pocket can be hung for the storage of a file such as a manilla folder containing sheets of typing or the like. The hanger has a solid molded plastic body 20 with a pair of steel pins or prongs 22 angled outwardly from the back of the body 20 and positioned parallel to each other. The prongs 22 are pushed into the wall so as to make the body 20 lie substantially parallel and flat against the wall providing a laterally extending hook-shaped bottom 21 terminating in an upwardly directed free end or nose 23 which is sized to readily pass through a slotted opening 28 in the plastic film pocket 25 or 26. The prongs 22 may be molded into the body 20 when it is manufactured or the prongs 22 may be added after the molding, e.g., by an adhesive or the like. Preferably, the prongs 22 are added when the body 20 is molded, prongs 22 actually being two ends of a single wire having a U-shape with the cross piece being encased in the body 20. The upper end of body 20 is thicker than the remainder of body 20 so as to provide a mass that will not break away due to the stress introduced therein by the cross piece connecting the two prongs 22 and due to weight of the file or files suspended by that hanger or hangers.

FIGS. 7–11 show the combination of one or more hook hangers 20 and a plastic film pocket folder 25 or 26. Pocket folder 25 is a single pocket of two pieces of plastic film sealed together around three sides and with an open top for the insertion of or the withdrawal of a file or even a single sheet of paper. Pocket folder 26 is larger and designed to contain perhaps three separate files in three separate sections of the folder 26, and because of its additional weight it is supported by two spaced hook hangers 20 inserted into two spaced slotted openings 28. As shown in FIG. 7, the hanger 20 is shown spaced away from wall panel 27. However, when properly positioned the rear face 35 of hanger body 20 will engage outer face 36 of wall panel 27, particularly when the folder 25 or 26 has items disposed therein. The hook hangers 20 could be used to support frames or wall clocks or items other than pocket folders so long as the item had an appropriate slot opening 28 adapted to be attached to the hook 21 of the hanger 20 to obtain the full benefits of the retention feature hereinafter described.

The present invention also provides a retention feature that improves the utility of the combination of a hanger and a pocket folder of this invention. This retention feature is best illustrated in FIG. 11. The outside surface of the lower portion of the hook hanger 20 is fashioned with a small shoulder or ridge 24 extending across the surface generally perpendicular to the long axis of the body 20 so that when a pocket folder 25 or 26 is suspended from the hook hanger 20 by the slot 28 in the pocket folder, the slot 28 slightly deforms so that the ridge 24 passes forwardly of outside surface 30 of pocket folder 25 or 26. The weight of the folder will be concentrated immediately behind ridge 24, i.e., the slot 28 will automatically hang on the hook 21 on the side of the ridge 24 which is next to the wall 27 to which hanger 20 is attached. This precise positioning of ridge 24 provides a resistance to pocket folder 25 or 26 sliding off hook surface 21 when a person attempts to remove papers from the pocket folder 25 or 26 without removing the pocket folder from hook body 20. It may be seen in FIG. 11 that the position of pocket folder 25 or 26 hanging from hook hanger 20 is at the bottom of the U-shaped portion of the hook as would be expected due to gravity. Immediately to the left (away from the wall 27 to which hanger 20 is attached) is ridge 24 with its edge lying against the outside surface 30 of the upper portion 31 of pocket folder 25 or 26. If one wishes to remove any part of the file or paper contained in the pocket of folder 25 or 26, it will tend to pull pocket folder 25 or 26 off the hook 21 of hanger 20, but because of the presence of ridge 24 the pocket folder 25 or 26 will be retained or restrained from being removed from the hook 21. If ridge 24 is sharp and deep, the restraint is strong, but may be weakened by adjusting the ridge to dull and shallow, resulting in less restraint. The relative sizes of ridge 24 and the pocket folder 25 or 26 and the size of the slot 28 will determine how well the restraint will work to prevent inadvertent removal of the entire pocket folder 25 or 26 and its contents each time a paper is removed from the pocket folder.

The hook hangers 20 may be made from any acceptable thermoplastic or thermosetting material that has an acceptable strength, and other desirable properties. Such materials include polyalkylenes, polyamides, polyaldehydes, polyesters, polyacrylics, etc. The flexible pocket folders similarly may be made from any of several materials that are suitable to form flexible plastic films, such as polyolefins, polyamides, polyesters, etc. The prongs 22 are made of a springy metal that is strong enough to puncture wall materials and sufficiently inflexible not to bend easily. Usually a metal is selected that does not rust or corrode, like stainless steel, but other materials may be selected like aluminum, copper, brass, and any of a variety of more expensive metals and their alloys, without departing from the scope of this invention.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States of America is:

1. A hanger for hanging articles from a vertical wall, the hanger comprising a generally rectangular body having a planar rear face and a planar front fact terminating in a lower outwardly and upwardly curved hook portion integral with said body, a pair of substantially parallel prongs spaced apart from each other and each having a sharp point directed downwardly and angled outwardly from said rear face of said body, said prongs each being formed integrally with said body, said hook portion extending generally at an acute angle to said planar front face of said body with an open part of said hook portion facing upwardly in a general opposite direction to said points of said prongs, said hook portion having a horizontal ridge extending generally parallel to a vertical plane of said body.

2. The hanger if claim 1 wherein said of said hook portion ridge extends downwardly from an outer surface.

3. The hanger of claim 2 wherein said ridge is located spacedly away from said rear and front faces of said body and forward of said vertical plane.

4. The hanger of claim 2 wherein said ridge extends horizontally a distance substantially equal to a lateral distance of said hook portion.

5. The hanger of claim 2 wherein said ridge is adapted and arranged to be located forward of a slot in a holder to be supported by said hanger.

6. The hanger of claim 2 wherein said hook portion includes a free end spaced upwardly toward a medial area of said rectangular body.

7. The hanger of claim 6 wherein said ridge is located spacedly away from and forward of said vertical plane of said body.

8. The hanger of claim 7 wherein said ridge extends a distance substantially equal to a lateral distance of said hook portion.

9. The hanger of claim 8 wherein said ridge is adapted and arranged to be located forward of a slot in a holder to be supported by said hanger.

10. The hanger of claim 1 wherein said hook portion includes a free end spaced upwardly toward a medial area of said body, said free end being reduced in width from a width of said rectangular body.

11. The hanger of claim 1 further comprising in combination a holder having a front wall and a back wall with said front wall being formed of flexible transparent plastic material closed on three side edges and open along horizontal top edges, said back wall extending above said front wall and having a horizontal slot therein, said slot receiving therethrough said hook portion to support said holder thereon.

12. The hanger of claim 11 wherein said ridge extends downwardly from said hook portion and being located forwardly of said holder back wall when said holder is supported by said hanger, said ridge engaging a shoulder of said slot to retain said holder on said hanger during removal of folders from said holder.

13. The hanger of claim 12 wherein said ridge extends substantially equal to a lateral distance of said hook portion.

14. The hanger of claim 13 wherein said slot is located substantially equally between opposite said closed side edges.

15. The hanger of claim 1 further comprising in combination, another hanger identical to said hanger of claim 1 and a holder having a plurality of pockets, said holder having at least a front wall and a back wall and closed on three side edges, said back wall extending above said front wall and having a pair of spaced horizontal slots therein, said slots respectively receiving therethrough said hook portion of said hanger and said another hanger to support said holder thereon.

16. The hanger of claim 15 wherein each said hanger and said another hanger includes said ridge extending downwardly from said hook portion and being located forwardly of said holder back wall when said holder is supported by said hanger and said another hanger, said ridges engaging respective shoulders of said slots to retain said holder on said hanger and said another hanger during removal of folders from said holder.

17. The hanger of claim 16 wherein said slots are located substantially equally from respective opposite said closed side edges.

18. The hanger of claim 16 wherein each said ridge of said hanger and said another hanger extends substantially equal to a lateral distance of each said hook portion.

19. The hanger of claim 15 wherein said holder is formed of a flexible transparent plastic material.

20. The hanger of claim 19 wherein said plurality of pockets partially overlie each other to form an expandable holder into which file folders may be inserted.

* * * * *